US006069120A

United States Patent [19]

Asgharian et al.

[11] Patent Number: 6,069,120

[45] **Date of Patent: *May 30, 2000**

[54] LIQUID ENZYME COMPOSITIONS CONTAINING MIXED POLYOLS AND METHODS OF USE

[75] Inventors: Bahram Asgharian; Bor-Shyue Hong, both of Arlington, Tex.

[73] Assignee: Alcon Laboratories, Inc., Fort Worth, Tex.

[ * ] Notice: This patent is subject to a terminal disclaimer.

[21] Appl. No.: 08/769,256

[22] Filed: Dec. 18, 1996

Related U.S. Application Data

[62] Division of application No. 08/516,664, Aug. 18, 1995, Pat. No. 5,605,661.

[51] Int. Cl.[7] ..... C11D 43/00

[52] U.S. Cl. ..... 510/114; 514/839; 514/840

[58] Field of Search ..... 510/114; 514/839, 514/840

[56] References Cited

U.S. PATENT DOCUMENTS

| | | | |
|---|---|---|---|
| Re. 32,672 | 5/1988 | Huth et al. | 252/95 |
| 3,873,696 | 3/1975 | Randeri et al. | 424/153 |
| 3,910,296 | 10/1975 | Karageozian et al. | 134/2 |
| 3,931,319 | 1/1976 | Green et al. | 260/567.6 P |
| 4,026,945 | 5/1977 | Green et al. | 260/567.6 P |
| 4,318,818 | 3/1982 | Letten et al. | 252/174.12 |
| 4,407,791 | 10/1983 | Stark | 424/80 |
| 4,414,127 | 11/1983 | Fu | 252/95 |
| 4,462,922 | 7/1984 | Boskamp | 252/174.12 |
| 4,525,346 | 6/1985 | Stark | 424/80 |
| 4,537,706 | 8/1985 | Severson, Jr. | 252/545 |
| 4,614,549 | 9/1986 | Ogunbiyi et al. | 134/19 |
| 4,615,882 | 10/1986 | Stockel | 424/80 |
| 4,717,662 | 1/1988 | Montgomery et al. | 435/99 |
| 4,758,595 | 7/1988 | Ogunbiyi et al. | 514/635 |
| 4,836,986 | 6/1989 | Ogunbiyi et al. | 422/28 |
| 5,039,446 | 8/1991 | Estell | 252/174.12 |
| 5,089,163 | 2/1992 | Aronson et al. | 252/135 |
| 5,096,607 | 3/1992 | Mowrey-McKee et al. | 252/106 |
| 5,281,277 | 1/1994 | Nakagawa et al. | 134/18 |
| 5,314,823 | 5/1994 | Nakagawa | 435/264 |
| 5,503,766 | 4/1996 | Kulperger | 252/174.12 |
| 5,605,661 | 2/1997 | Asgharian et al. | 422/28 |

FOREIGN PATENT DOCUMENTS

| | | |
|---|---|---|
| 1 150 907 | 8/1983 | Canada . |
| 0 456 467 A2 | 11/1991 | European Pat. Off. . |
| 82-24526 | 5/1982 | Japan . |
| 92-180515 | 7/1989 | Japan . |
| 92-93919 | 3/1992 | Japan . |
| 92-143718 | 5/1992 | Japan . |
| 92-243215 | 8/1992 | Japan . |
| 92-370197 | 12/1992 | Japan . |
| WO 95/12655 | 5/1995 | WIPO . |

OTHER PUBLICATIONS

Lo, et al., "Studies on cleaning solution for contact lenses", *Journal of The American Optometric Association*, vol. 40, No. 11, pp. 1106–1109 (1969).

Crossin, M. C., "Protease Stabilization by Carboxylic Acid Salts: Relative Efficiencies and Mechanisms", *Journal of the American Oil Chemists*, vol. 66, No. 7, pp. 1010–1014 (1989).

Royer, "Peptide Synthesis in Water and the Use of Immobilized Carboxypeptidase Y for Deprotection", *Journal of the American Chemical Society*, vol. 101, pp. 3394–3396 (1979).

Fuke, I., et al., "Synthesis of poly (ethylene glycol) derivatives with different branchings and their use for protein modification", *Journal of Controlled Release*, vol. 30, pp. 27–34 (1994).

Segal, et al., "The interaction of alkynyl carboxylates with serine enzymes", *FEBS Letters*, vol. 247, No. 2, pp. 217–220 (1989).

Delgado, "Solubility behavior of enzymes after addition of polyethylene glycol to erthrocyte hemolysates", *Biotechnology And Applied Biochemistry*, vol. 10, No. 3, pp. 251–256 (1988).

*Primary Examiner*—Paul F. Shaver
*Attorney, Agent, or Firm*—Michael C. Mayo

[57] ABSTRACT

Compositions containing a stable, liquid, ophthalmically acceptable enzyme and methods involving the combined use of these compositions with a polymeric antimicrobial agent are disclosed for the simultaneous cleaning and disinfecting of contact lens. Methods for a daily use regimen are also disclosed.

10 Claims, No Drawings

LIQUID ENZYME COMPOSITIONS CONTAINING MIXED POLYOLS AND METHODS OF USE

This is a division, of application Ser. No. 08/516,664, filed Aug. 18, 1995 now U.S. Pat. No. 5,605,661.

BACKGROUND OF THE INVENTION

The present invention relates to the field of contact lens cleaning and disinfecting. In particular, this invention relates to liquid enzyme compositions and methods for cleaning human-worn contact lenses with those compositions. The invention also relates to methods of simultaneously cleaning and disinfecting contact lenses by combining the liquid enzyme compositions of the present invention with a chemical disinfecting agent.

Various compositions and methods for cleaning contact lenses have been described in the patent and scientific literature. Some of these methods have employed compositions containing surfactants or enzymes to facilitate the cleaning of lenses. The first discussion of the use of proteolytic enzymes to clean contact lenses was in an article by Lo, et al. in the *Journal of The American Optometric Association,* volume 40, pages 1106–1109 (1969). Methods of removing protein deposits from contact lenses by means of proteolytic enzymes have been described in many publications since the initial article by Lo, et al., including U.S. Pat. No. 3,910,296 (Karageozian, et al.).

Numerous compositions and methods for disinfecting contact lenses have also been described. Those methods may be generally characterized as involving the use of heat and/or chemical agents. Representative chemical agents for this purpose include organic antimicrobials such as benzalkonium chloride and chlorhexidine, and inorganic antimicrobials such as hydrogen peroxide and peroxide-generating compounds. U.S. Pat. Nos. 4,407,791 and 4,525,346 (Stark) describe the use of polymeric quaternary ammonium compounds to disinfect contact lenses and to preserve contact lens care products. U.S. Pat. Nos. 4,758,595 and 4,836,986 (Ogunbiyi) describe the use of polymeric biguanides for the same purpose.

Various methods for cleaning and disinfecting contact lenses at the same time have been proposed. Such methods are described in U.S. Pat. No. 3,873,696 (Randeri, et al.) and U.S. Pat. No. 4,414,127 (Fu), for example. A representative method of simultaneously cleaning and disinfecting contact lenses involving the use of proteolytic enzymes to remove protein deposits and a chemical disinfectant (monomeric quaternary ammonium compounds) is described in Japanese Patent Publication 57-24526 (Boghosian, et al.). The combined use of a biguanide (i.e., chlorhexidine) and enzymes to simultaneously clean and disinfect contact lenses is described in Canadian Patent No. 1,150,907 (Ludwig). Methods involving the combined use of dissolved proteolytic enzymes to clean and heat to disinfect are described in U.S. Pat. No. 4,614,549 (Ogunbiyi). The combined use of proteolytic enzymes and polymeric biguanides or polymeric quaternary ammonium compounds is described in copending, and commonly assigned U.S. patent application Ser. No. 08/156,043 and in corresponding European Patent Application Publication No. 0 456 467 A2.

The commercial viability of prior enzyme/disinfectant combinations has depended on the use of a stable enzyme tablet. More specifically, the use of solid enzymatic cleaning compositions has been necessary to ensure stability of the enzymes prior to use. In order to use such compositions, a separate packet containing a tablet must be opened, the tablet must be placed in a separate vial containing a solution, and the tablet must be dissolved in order to release the enzyme into the solution. This practice is usually performed only once a week due to the cumbersome and tedious procedure and potential for irritation and toxicity. Moreover, the enzymatic cleaning tablets contain a large amount of excipients, such as effervescent agents (e.g., bicarbonate) and bulking agents (e.g., compressible sugar). As explained below, such excipients can adversely affect both cleaning and disinfection of the contact lenses.

There have been prior attempts to use liquid enzyme compositions to clean contact lenses. However, those attempts have been hampered by the fact that aqueous liquid enzyme compositions are inherently unstable. When a proteolytic enzyme is placed in an aqueous solution for an extended period (i.e., several months or more), the enzyme may lose all or a substantial portion of its proteolytic activity. Steps can be taken to stabilize the compositions, but the use of stabilizing agents may have an adverse effect on the activity of the enzyme. For example, stabilizing agents can protect enzymes from chemical instability problems during storage in an aqueous liquid, by inhibiting the enzymes from normal activity. However, such agents may also inhibit the ability of the enzymes to become active again at the time of use. Finally, in addition to the general problems referred to above, a commercially viable liquid enzyme preparation for treating contact lenses must be relatively nontoxic, and must be compatible with other chemical agents used in treating contact lenses, particularly antimicrobial agents utilized to disinfect the lenses.

The following patents may be referred to for further background concerning prior attempts to stabilize liquid enzyme formulations: U.S. Pat. No. 4,462,922 (Boskamp); U.S. Pat. No. 4,537,706 (Severson); and U.S. Pat. No. 5,089,163 (Aronson). These patents describe detergent compositions containing enzymes. The detergent compositions may be used to treat laundry, as well as other industrial uses. Such detergents are not appropriate for treating contact lenses.

U.S. Pat. No. 5,281,277 (Nakagawa) and Japanese Kokai Patent Applications Nos. 92-93919 and 92-180515 describe liquid enzyme compositions for treating contact lenses. The compositions of the present invention are believed to provide significant improvements relative to the compositions described in those publications.

SUMMARY OF THE INVENTION

The present invention is based in part on the finding that particular liquid enzyme compositions possess stability, preservative efficacy, and, when used in conjunction with a physiologically compatible, disinfecting solution, provide a good comfort and safety profile. Thus, the present invention has overcome issues of toxicity and efficacy to provide a more effective, yet physiologically delicate, system for cleaning contact lenses.

The compositions and methods of the present invention provide greater ease of use, and therefore, greater user compliance. This ease of use enables contact lens users to clean their lenses 2 to 3 times a week, or more preferably, every day.

The liquid enzyme compositions of the present invention contain critical amounts of selected stabilizing agents. The stabilizing agents utilized are combinations of monomeric and polymeric polyols. The amounts of stabilizing agents utilized have been delicately balanced, such that maximum stability is achieved, while maximum activity is later obtained when the composition is put into use. A disinfectant may optionally be added for the preservation of the liquid enzyme compositions of the present invention from microbial contamination when the compositions are packaged in multiple use containers.

The present invention also provides methods for cleaning contact lenses with the above described liquid enzyme compositions. In order to clean a soiled lens, the lens is placed in a few milliliters of an aqueous solution and a small amount, generally one to two drops, of the enzyme composition is added to the solution. The lens is then soaked in the resultant cleaning solution for a time sufficient to clean the lens.

The liquid enzyme compositions of the present invention are preferably combined with an aqueous disinfecting solution to simultaneously clean and disinfect contact lenses. As will be appreciated by those skilled in the art, the disinfecting solution must be formulated so as to be compatible with contact lenses and ophthalmic tissues. The pH and osmolality or tonicity of the disinfecting solutions are particularly important. The solutions must have a pH of approximately 7.0 and a tonicity ranging from hypotonic to isotonic. The antimicrobial activity of many chemical disinfecting agents is adversely effected by ionic solutes (e.g., sodium chloride). Accordingly, the use of hypotonic solutions, that is, solutions having a relatively low concentration of ionic solutes, is generally preferred. Significantly, the use of the above described compositions has only a minor impact on the ionic strength of the disinfecting solution, and thus little to no effect on the antimicrobial efficacy of the disinfecting solution. As used in the methods of the present invention, 1 drop of the above described liquid enzyme compositions contributes only about 20–50 milliOsmoles per kilogram (mOs/kg) when added to about 5 mL of disinfecting solution, while prior enzyme tablet compositions contribute 100 to 200 or more mOs/kg to the same solution, due to the excipients needed to promote effervescing dissolution of the tablet or to add bulk.

DETAILED DESCRIPTION OF THE INVENTION

The compositions of the present invention employ a "mixed polyol" to stabilize the enzyme in an aqueous medium. While Applicants do not wish to be bound by any theory, it is believed that the stability of these enzymes is enhanced by changing the conformation of the proteins. The enzymes are conformationally altered by forming a complex with the polyols. The enzymes are altered to a point where the enzymes are inactivated, but where the active conformation is easily achieved by dilution of the enzyme/stabilizing agent complex in an aqueous medium. It is believed that the polyols compete with water for hydrogen bonding sites on the proteins. Thus, a certain percentage of these agents will effectively displace a certain percentage of water molecules. As a result, the proteins will change conformation to an inactive and complexed (with the polyols) form. When the enzyme is in an inactive form, it is prevented from self-degradation and other spontaneous, chemically irreversible events. On the other hand, displacement of too many water molecules results in protein conformational changes that are irreversible. In order to obtain a stable liquid enzyme composition of significant shelf life and thus commercial viability, a delicate balance point of maximum stability and maximum reversible renaturation must be ascertained.

The polyols utilized in the present invention are monomeric and polymeric, and the term "mixed polyols" refers to a mixture of monomeric and polymeric polyols. As used herein, the term "monomeric polyol" refers to a compound with 2 to 6 carbon atoms and at least two hydroxy groups. Examples of monomeric polyols are glycerol, propylene glycol, ethylene glycol, sorbitol and mannitol. As used herein, the term "polymeric polyol" refers to a polyalkoxylated glycol with a molecular weight ranging from 200–600. Examples of polymeric polyols are polyethylene glycol 200 (denoting a molecular weight of 200, "PEG 200") and PEG 400. The PEGs may optionally be monoalkoxylated. Examples of monoalkoxylated PEGs are monomethoxy PEG 200 and ethoxy PEG 400. Though these alkoxylated PEGs are not technically polyols, they are similar in structure to the non-alkoxylated PEGs; therefore, for defining purposes, they are included in the term "polmeric polyol."

Both monomeric and polymeric polyols have the ability to stabilize enzymes. The use of a mixed polyol combines the abilities and advantages of both monomeric and polymeric polyols, while reducing the negative effects of using a higher quantity of either polyol alone.

Monomeric polyols, used at high concentrations (greater than 30% weight/volume, "% w/v"), can cause numerous problems in liquid enzyme compositions. For example, when one or more drops of an enzyme composition containing a high concentration of a monomeric polyol, such as glycerol, is diluted in a disinfecting solution containing a borate buffering agent, hydrogen ions can liberate thus lowering the pH. Lower pH of the resultant enzyme/disinfectant solution can cause ineffective enzyme cleaning and can also lead to ocular irritation if the lens is not rinsed thoroughly. Additionally, high concentrations of monomeric polyols, such as mannitol or glycerol, are viscous and thus more difficult to dispense from a drop dispenser. Furthermore, high concentrations of polyols increase the osmolality of the resultant enzyme composition/disinfecting solution mixture; these osmolality increases may further be compounded by the use of borates. This is significant as increases in osmolality may have an adverse effect on the antimicrobial activity of the disinfecting solution.

PEGs (polymeric polyols) do not exhibit the adverse properties of the monomeric polyols described above. However, enzymes or other stabilizing agents such as borates, are less soluble in an aqueous medium containing high PEG concentrations (greater than 40% w/v) (Delgado, *Solubility behavior of enzymes after addition of polyethylene glycol to erthrocyte hemolysates, Biotechnology and Applied Biochemistry,* volume 10, No. 3, pages 251–256 (1988)). Furthermore, compositions with high PEG concentrations do not readily disperse in a disinfecting solution, thus causing a slower rate of release of the enzyme in the solution. Finally, PEGs are not as effective at stabilizing the enzymes as monomeric polyols.

The present invention overcomes the problems of using either high concentrations of monomeric polyols or high concentrations of polymeric polyols alone, by combining the two types of polyols in lower concentrations. For example, instead of using glycerol at 50% w/v (which may lead to pH problems), or PEG 400 at 50% w/v (which may lead to poor solubility), the present invention may combine the components at 25% w/v and 25% w/v, respectively. Therefore, though the combined concentration of the two polyols is high enough to achieve stability, the deleterious effects of each component are minimized as each component is now present in a smaller concentration.

The amounts of the components comprising the mixed polyol will vary depending on the particular combination of polyols used. In general, liquid enzyme compositions of the present invention will require 30–70% w/v of a mixed polyol mixture to achieve the necessary criteria for efficacious and commercially viable liquid enzyme compositions, as described above. The combination of about 50% w/v of a mixed polyol (25% w/v glycerol and 25% w/v PEG 400) is most preferred. The ratio of monomeric to polymeric polyols is also important. In general, the monomeric polyol:polymeric polyol ratio will be from 1:5 to 5:1, with a preferred ratio being 2:1 to 1:2, weight:weight. While any of the polyols can be components of the compositions of the present invention, particular polyols may be used depending on the particular intended use. For example, propylene glycol, which has preservative activity, is a preferred monomeric polyol when the need for an additional preservative present in a liquid enzyme composition of the present invention is desired.

A variety of preservatives may be employed to preserve liquid enzyme compositions of the present invention intended for multi-dispensing. In general, any of the disinfecting agents listed below for use in the disinfecting solutions of the methods of the present invention, with the exception of oxidative disinfecting agents, may be used. Particularly preferred, are the polymeric quaternary ammonium compounds, the most preferred is polyquaternium-1. The amount of preservative used will depend on several factors including the anti-microbial efficacy of the particular agent and any synergistic interaction the agent may have with the liquid enzyme composition. In general, 0.0001 to 0.1% w/v of the preservative agent will be used.

The compositions of the present invention may optionally contain a reversible enzyme inhibitor. The inhibitor will be added in an amount necessary to inactivate the enzyme, but where reactivation is easily achieved by dilution of the inhibited enzyme/stabilizing agent complex in an aqueous medium. When the enzyme is in an inactive form, it is prevented from self-degradation and other spontaneous, chemically irreversible events. Examples of reversible inhibitors are borates, including phenyl boronic acids, aromatic acids and lower alkyl carboxylic acids such as propanoic and butyric acids. As used herein, the term "lower carboxylic acid" refers to a compound having a carboxylic acid group and from 2–4 carbon atoms in total. Preferred inhibitors include aromatic acid derivatives, such as benzoic acid. The preferred range of an aromatic acid derivative used in the present invention is 0.01 to 5.0% w/v.

The compositions may contain additional stabilization agents. These include multi-valent ions, such as calcium and magnesium and their salts. Calcium chloride is a preferred agent and may optionally be added to compositions of the present invention in the amount of 0.001 to 0.1% w/v.

Other ingredients may optionally be added to the liquid enzyme compositions of the present invention. Such ingredients include buffering agents, such as, Tris, phosphate or borate buffers; tonicity adjusting agents, such as NaCl or KCl; metal chelating agents, such as ethylenediaminetetraacetic acid (EDTA) and pH adjusting agents such as sodium hydroxide, Tris, triethanolamine and hydrochloric acid.

The compositions may contain one or more surfactants selected from anionic, non-ionic or amphoteric classes. Examples of non-ionic surfactants include alkyl polyoxyethylene alcohols, alkyl phenyl polyoxyethylene alcohols, polyoxyethylene fatty acid esters, polyethylene oxide-polypropylene oxide copolymers such as polaxomers and polaxamines. Examples of anionic surfactants include alkyl sarcosinates and alkyl glutamates. Examples of amphoteric surfactants include alkyliminopropionates and alkylamphoacetates. In general, 0 to 5% w/v of the surfactant will be used.

The enzymes which may be utilized in the compositions and methods of the present invention include all enzymes which: (1) are useful in removing deposits from contact lenses; (2) cause, at most, only minor ocular irritation in the event a small amount of enzyme contacts the eye as a result of inadequate rinsing of a contact lens; (3) are relatively chemically stable and effective in the presence of the antimicrobial agents described below; and (4) do not adversely affect the physical or chemical properties of the lens being treated. For purposes of the present specification, enzymes which satisfy the foregoing requirements are referred to as being "ophthalmically acceptable."

The proteolytic enzymes used herein must have at least a partial capability to hydrolyze peptide-amide bonds in order to reduce the proteinaceous material found in lens deposits to smaller water-soluble subunits. Typically, such enzymes will exhibit some lipolytic, amylolytic or related activities associated with the proteolytic activity and may be neutral, acidic or alkaline. In addition, separate lipases or carbohydrases may be used in combination with the proteolytic enzymes, as well as thermally stable proteases.

Examples of suitable proteolytic enzymes include but are not limited to pancreatin, trypsin, subtilisin, collagenase, keratinase, carboxylase, papain, bromelain, aminopeptidase, Aspergillo peptidase, pronase E (from *S. griseus*) and dispase (from *Bacillus polymyxa*) and mixtures thereof. If papain is used, a reducing agent, such as N-acetylcysteine, may be required.

Microbial derived enzymes, such as those derived from Bacillus, Streptomyces, and Aspergillus microorganisms, represent a preferred type of enzyme which may be utilized in the present invention. Of this sub-group of enzymes, the most preferred are the Bacillus derived alkaline proteases generically called "subtilisin" enzymes.

The identification, separation and purification of enzymes is known in the art. Many identification and isolation techniques exist in the general scientific literature for the isolation of enzymes, including those enzymes having proteolytic and mixed proteolytic/amylolytic or proteolytic/lipolytic activity. The enzymes contemplated by this invention can be readily obtained by known techniques from plant, animal or microbial sources.

With the advent of recombinant DNA techniques, it is anticipated that new sources and types of stable proteolytic enzymes will become available. Such enzymes should be considered to fall within the scope of this invention so long as they meet the criteria for stability and activity set forth herein.

Chemically modified enzymes are also contemplated by the compositions and methods of the present invention. For example, enzymes that have been site-mutated with a natural or unnatural amino acid or enzymes which have been covalently linked to polymeric compounds may be used in the present invention. Me-PEG-subtilisin, a subtilisin covalently modified by a monomethoxy-capped polyethylene glycol, linked by a methylether bond, and having an average molecular weight of 5000, is a preferred enzyme of the present invention.

Pancreatin, subtilisin and trypsin are the most preferred enzymes for use in the present invention. Pancreatin is extracted from mammalian pancreas, and is commercially available from various sources, including Scientific Protein Laboratories (Waunakee, Wis., U.S.A.), Novo Industries (Bagsvaerd, Denmark), Sigma Chemical Co. (St. Louis, Mo., U.S.A.), and Boehringer Mannheim (Indianapolis, Ind., U.S.A.). Pancreatin USP is a mixture of proteases, lipases and amylases, and is defined by the United States Pharmacopeia ("USP"), as containing 1 USP unit each for proteases, lipases and amylases, respectively. The most preferred form of pancreatin is Pancreatin 9X. As utilized herein, the term "Pancreatin 9X" means a filtered (0.2 mm) pancreatin containing nine times the USP protease unit content. Subtilisin is derived from Bacillus bacteria and is commercially available from various commercial sources including Novo Industries (Bagsvaerd, Denmark), Fluka Biochemika (Buchs, Germany) and Boehringer Mannheim. Trypsin is purified from various animal sources and is commercially available from Sigma Chemical Co. and Boehringer Mannheim. Me-PEG-5000-subtilisin is a preferred polymer modified enzyme and can be made by the method illustrated in Example 5.

The amount of enzyme used in the liquid enzyme compositions of the present invention will range from about 0.01 to 10% w/v, due to various factors, such as purity, specificity and efficacy. The preferred compositions of the present invention will contain pancreatin in the range of about 1 to 2% w/v; subtilisin in a range of about 0.01 to 0.3% w/v; trypsin in the range of 0.1 to 0.7% w/v; or Me-PEG-5000-subtilisin in the amount of 0.1 to 10.0% w/v.

The cleaning methods of the present invention involve the use of an amount of enzyme effective to remove substantially or to reduce significantly deposits of proteins, lipids, mucopolysaccharides and other materials typically found on human-worn contact lenses. For purposes of the present specification, such an amount is referred to as "an amount effective to clean the lens." The amount of liquid enzyme cleaning composition utilized in particular embodiments of the present invention may vary, depending on various factors, such as the purity of the enzyme utilized, the proposed duration of exposure of lenses to the compositions, the nature of the lens care regimen (e.g., the frequency of lens disinfection and cleaning), the type of lens being treated, and the use of adjunctive cleaning agents (e.g., surfactants).

The liquid enzyme compositions of the present invention must be formulated to provide storage stability and antimicrobial preservation suitable for multiple use dispensing, and must provide effective enzymatic activity to breakdown and hence remove proteinaceous and other foreign deposits on the contact lens. The liquid enzyme compositions must not contribute to the adverse effects of deposit formation on the lens, ocular irritation, or immunogenicity from continuous use. Additionally, when combined with a disinfecting solution containing an antimicrobial agent which is adversely affected by high ionic strength such as polyquaternium-1, the compositions of the present invention must have little or no impact on the ionic strength of the disinfecting solution.

As used in the present specification, the term "low osmolality effect" is defined as an increase in osmolality of about 0–50 milliOsmoles/kg when 1 to 2 drops of the liquid enzyme composition is added to the diluent solution. Osmolality is an indirect measure of available $H_2O$ hydrogen bonding and ionic strength of a solution. It is convenient to utilize osmolality measurements to define acceptable tonicity ranges for disinfecting solutions. As indicated above, the antimicrobial activity of disinfecting agents, particularly polymeric quaternary ammonium compounds such as polyquaternium-1, is adversely affected by high concentrations of sodium chloride or other ionic solutions.

The ionic strength or tonicity of the cleaning and disinfecting solution of the present invention has been found to be an important factor. More specifically, polymeric ammonium compounds, and particularly those of Formula (I), below, lose antimicrobial activity when the concentration of ionic solutes in the disinfecting solution is increased. The use of solutions having low ionic strengths (i.e., low concentrations of ionic solutes such as sodium chloride) is therefore preferred. Such low ionic strengths generally correspond to osmolalities in the range of hypotonic to isotonic, and more preferably in the range of 150 to 350 milliOsmoles per kilogram (mOs/kg). A range of 200 to 300 mOs/kg being is particularly preferred and a tonicity of about 220 mOs/kg is most preferred.

The liquid enzyme composition of the present invention must demonstrate effective cleaning efficacy while exhibiting minimal effects on the anti-microbial efficacy of the disinfecting solution to which it is combined, when lenses are treated for extended periods of approximately one hour to overnight, with four to eight hours preferred.

As described above, a range of ionic strength, expressed in osmolality units, is critical for the antimicrobial efficacy of polymeric disinfecting agents. While the liquid enzyme cleaning compositions of the present invention have a high osmolality, due to the high concentration of a mixed polyol, only 1 to 2 drops (approximately 30–60 uL) of the compositions are added to 2–10 mL of a disinfecting solution. The addition of 1 drop of the compositions of the present invention to 5 mL of a disinfecting solution increases the osmolality by about 20–50 mOsm/kg. Furthermore, this contribution to osmolality is primarily non-ionic. Therefore, the contribution of the compositions to the final ionic strength and osmolality of the enzyme/disinfectant solution is minor and is considered negligible.

The methods of the present invention utilize a disinfecting solution containing an antimicrobial agent. Antimicrobial agents can be oxidative, such as hydrogen peroxide, or non-oxidative polymeric antimicrobial agents which derive their antimicrobial activity through a chemical or physicochemical interaction with the organisms. As used in the present specification, the term "polymeric antimicrobial agent" refers to any nitrogen-containing polymer or co-polymer which has antimicrobial activity. Preferred polymeric antimicrobial agents include: polymeric quaternary ammonium compounds, such as disclosed in U.S. Pat. No. 3,931,319 (Green, et al.), U.S. Pat. No. 4,026,945 (Green, et al.) and U.S. Pat. No. 4,615,882 (Stockel, et al.) and the biguanides, as described below. The entire contents of the foregoing publications are hereby incorporated in the present specification by reference. Other antimicrobial agents suitable in the methods of the present invention include: benzalkonium halides, and biguanides such as salts of alexidine, alexidine free base, salts of chlorhexidine, hexamethylene biguanides and their polymers. The polymeric antimicrobial agents used herein are preferably employed in the absence of mercury-containing compounds such as thimerosal. The salts of alexidine and chlorhexidine can be either organic or inorganic and are typically gluconates, nitrates, acetates, phosphates, sulphates, halides and the like.

Particularly preferred are polymeric quaternary ammonium compounds of the structure:

(I)

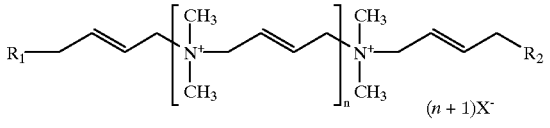

wherein:

$R_1$ and $R_2$ can be the same or different and are selected from:

$N^+(CH_2CH_2OH)_3X^-$, $N(CH_3)_2$ or OH;

X is a pharmaceutically acceptable anion, preferably chloride; and n is an integer from 1 to 50.

The most preferred compounds of this structure is polyquaternium-1, which is also known Onamer M™ (registered trademark of Onyx Chemical Corporation) or as Polyquad® (registered trademark of Alcon Laboratories, Inc.).

The above-described antimicrobial agents are utilized in the methods of the present invention in an amount effective to eliminate substantially or to reduce significantly the number of viable microorganisms found on contact lenses, in accordance with the requirements of governmental regulatory agencies, such as the United States Food and Drug Administration. For purposes of the present specification, that amount is referred to as being "an amount effective to disinfect" or "an antimicrobial effective amount." The amount of antimicrobial agent employed will vary, depending on factors such as the type of lens care regimen in which the method is being utilized. For example, the use of an efficacious daily cleaner in the lens care regimen may substantially reduce the amount of material deposited on the lenses, including microorganisms, and thereby lessen the amount of antimicrobial agent required to disinfect the lenses. The type of lens being treated (e.g., "hard" versus "soft" lenses) may also be a factor. In general, a concentration in the range of about 0.000001% to about 0.01% w/v of one or more of the above-described antimicrobial agents will be employed. The most preferred concentration of the polymeric quaternary ammonium compounds of Formula (I) is about 0.001% w/v.

Oxidative disinfecting agents may also be employed in the methods of the present invention. Such oxidative disinfecting agents include various peroxides which yield active oxygen in solution. Preferred methods will employ hydrogen peroxide in the range of 0.3 to 3.0% w/v to disinfect the lens. Methods utilizing an oxidative disinfecting system are described in U.S. Pat. No. Re 32,672 (Huth, et al.) the entire contents of which, are hereby incorporated in the present specification by reference.

As will be appreciated by those skilled in the art, the disinfecting solutions utilized in the present invention may contain various components in addition to the above-described antimicrobial agents, such as suitable buffering agents, chelating and/or sequestering agents and tonicity adjusting agents. The disinfecting solutions may also contain surfactants.

The tonicity adjusting agents, which may be a component of the disinfecting solution and may optionally be incorporated into the liquid enzyme composition, are utilized to adjust the osmotic value of the final cleaning and disinfecting solution to more closely resemble that of human. Suitable tonicity adjusting agents include, but are not limited to, sodium and potassium chloride, dextrose, calcium and magnesium chloride, the buffering agents listed above are individually used in amounts ranging from about 0.01 to 2.5% w/v and preferably, from about 0.5 to about 1.5% w/v.

Suitable surfactants can be either cationic, anionic, nonionic or amphoteric. Preferred surfactants are neutral or nonionic surfactants which may be present in amounts up to 5% w/v. Examples of suitable surfactants include, but are not limited to, polyethylene glycol esters of fatty acids, polyoxyethylene ethers of $C_{12}$–$C_{18}$ alkanes and polyoxyethylene-polyoxypropylene block copolymers of ethylene diamine (i.e. poloxamine).

Examples of preferred chelating agents include ethylenediaminetetraacetic acid (EDTA) and its salts (e.g., disodium) which are normally employed in amounts from about 0.025 to about 2.0% w/v.

The methods of the present invention will typically involve adding a small amount of a liquid enzyme composition of the present invention to about 2 to 10 mL of disinfecting solution, placing the soiled lens into the enzyme/disinfectant solution, and soaking the lens for a period of time effective to clean and disinfect the lens. The small amount of liquid enzyme composition can range due to various applications and the amount of disinfecting solution used, but generally it is about 1 to 2 drops. The soiled lens can be placed in the disinfecting solution either before or after the addition of the liquid enzyme composition. Optionally, the contact lenses are first rubbed with a daily surfactant cleaner prior to immersion in the enzyme/disinfectant solution. The lens will typically be soaked overnight, but shorter or longer durations are contemplated by the methods of the present invention. A soaking time of 4 to 8 hours is preferred. The methods of the present invention allow the above-described regimen to be performed once per week, but more preferably, every day.

The following examples are presented to illustrate further, various aspects of the present invention, but are not intended to limit the scope of the invention in any respect.

EXAMPLE 1

A specific liquid enzyme composition of the present invention, and a suitable disinfecting solution for use in combination with that composition, are described below:

A. Liquid Subtilisin Composition

The following liquid enzyme composition represents a preferred embodiment of the present invention:

| Ingredient | Amount % w/v |
|---|---|
| Subtilisin A | 0.1% |
| Benzoic Acid | 1.0% |
| Calcium chloride | 0.01% |
| Glycerol | 25% |
| PEG 400 | 25% |
| Polyquaternium-1 | 0.003% |
| Purified water | QS |
| Sodium hydroxide | QS** |

Note: (w/v) means weight/volume; and QS means quantity sufficient ** to adjust to an opthalmically acceptable pH The above formulation was prepared by first adding glycerol and PEG-400 to 40% of the batch of purified water while mixing. To this mixture, benzoic acid, calcium chloride and polyquaternium-1 were added and allowed to dissolve. The pH was then adjusted to the desired pH range with sodium hydroxide. The enzyme was then added and the volume adjusted to 100% with purified water. The optimal pH of the above formulation is in the range of 6–8, a pH of 7.5 is most preferred.

B. Disinfecting Solution

The following formulation represents a preferred disinfecting solution:

| Ingredient | w/v (%) |
|---|---|
| Polyquaternium-1 | 0.001 + 10% excess |
| Sodium chloride | 0.48 |
| Disodium Edetate | 0.05 |
| Citric acid monohydrate | 0.021 |
| Sodium citrate dihydrate | 0.56 |
| Purified water | QS |

To prepare the above formulation, sodium citrate dihydrate, citric acid monohydrate, disodium edetate, sodium chloride and polyquaternium-1, in the relative concentrations indicated above, were mixed with purified water and the components allowed to dissolve by stirring with a mixer. Purified water was added to bring the solution to almost 100%. The pH was recorded at 6.3 and adjusted to 7.0 with NaOH. Purified water was added to bring the solution to 100%. The solution was stirred and a pH reading of 7.0 was taken. The solution was then filtered into sterile bottles and capped.

The following Examples (2–4) illustrate enzyme stability as a function of enzyme activity. Example 2 illustrates the the lower limit of polyol needed for the thermal stabilization of the enzyme in liquid enzyme compositions of the present invention. Examples 3 and 4 illustrate the thermal stability efficacy of compositions of the present invention. Enzyme activity was asertained by the following azocasein method:

Azocasein Method:

The following solutions are used in this assay:

1) Buffer solution: 0.05 M sodium phosphate buffer containing 0.9% sodium chloride, pH 7.6.
2) Substrate solution: 2 mg/ml azocasein in the buffer solution mentioned above.

The assay is initiated by mixing 1 ml of an appropriately diluted (such that the enzyme activity is in the range of standard curve) enzyme composition in phosphate buffer with 2 ml of azocasein substrate solution (2 mg/ml). After incubation at 37° C. for 20 minutes, the mixture is removed from the incubator and 1 ml of trichloroacetic acid (14% w/v) is added to stop the enzyme reaction. The mixture is vortexed well and allowed to stand at room temperature for 20 minutes. After centrifuging at 2500 rpm (with a Beckman GS-6R Centrifuge) for 15 minutes, the supernatant is filtered with a serum sampler. 2 ml of the clear yellow filtrate is then adjusted to a neutral pH with 0.4 ml of 0.1 N sodium hydroxide and the absorbance of 440 nm wavelength light is measured with a spectrophotometer. The amount of azocasein hydrolyzed is calculated based on a standard curve of known concentrations of azocasein solution developed under identical conditions. An enzyme activity unit ("AZ U") is defined as that amount of enzyme which hydrolyzes 1 $\mu$g of azocasein substrate/minute at 37° C.

EXAMPLE 2

Compositions 1–5 were assayed for enzyme activity by the azocasein method described above. Aliquots of each composition were stored for 24 hours, 1 week, 3 weeks, or 5 weeks at 4°, 45° or 55° C.; and additionally for 7 weeks at 4° or 45° C. At the specified time point the aliquot was pulled and tested for enzyme activity. The data is expressed as percent enzyme activity with respect to the 4° C. (control) aliquot (for that given timepoint) in Table 1 below:

TABLE 1

Comparison of Polyol Concentration on Enzyme Stability

| Composition | | 1 | 2 | 3 | 4 |
|---|---|---|---|---|---|
| Subtilisin A % w/v | | 0.1 | 0.1 | 0.1 | 0.1 |
| Boric Acid % w/v | | 5 | 5 | 5 | 5 |
| Glycerol % w/v | | 10 | 25 | 40 | 50 |
| Purified Water | | QS | QS | QS | QS |
| pH | | 7.5 | 7.5 | 7.5 | 7.5 |
| Temperature | Time | Percent Enzyme Activity | | | |
| 55° C. | 24 hrs. | 82.8 | 89.2 | 96.9 | 100 |
| | 1 week | 0.7 | 65.2 | 89.7 | 93.0 |
| | 3 weeks | 2.1 | 7.3 | 61.6 | 80.4 |
| | 5 weeks | | 0.3 | 20.3 | 56.1 |
| 45° C. | 1 week | 81.5 | 95.5 | 98.8 | 100 |
| | 3 weeks | 57.4 | 77.7 | 93.0 | 98.5 |
| | 5 weeks | — | 59.0 | 85.1 | 94.8 |
| | 7 weeks | — | — | 78.8 | 88.4 |
| 4° C. | 24 hrs. | 3067 | 3297 | 3074 | 3156 |
| Enzyme | 1 week | 3219 | 3265 | 3219 | 3219 |
| Activity | 3 weeks | 3425 | 3601 | 3501 | 3662 |
| (AZ U/ml) | 5 weeks | — | 3186 | 3053 | 3144 |
| | 7 weeks | — | — | 2953 | 3049 |

The data of Table 1 demonstrates that a polyol concentration between 25 and 40% is the lower limit necessary for long term stability of an enzyme in a liquid composition.

The following comparative example illustrates the thermal enzyme stability of liquid compositions containing only a monomeric polyol, only a polymeric polyol or mixed polyol.

EXAMPLE 3

Composition 5 contains 50% w/v of a monomeric polyol, whereas composition 7 contains 50% w/v of a polymeric polyol. Composition 6, a composition of the present invention, contains 50% w/v of a mixed polyol. The experiment was performed as in Example 2 above.

TABLE 2

Comparison of Monomeric, Polymeric or Mixed Polyol Compositions on Enzyme Stability

| Composition | | 5 | 6 | 7 |
|---|---|---|---|---|
| Pancreatin 9X % w/v | | 1.7 | 1.7 | 1.7 |
| Boric acid % w/v | | 5.0 | 5.0 | 5.0 |
| Glycerol % w/v | | 50 | 25 | — |
| PEG 400 % w/v | | — | 25 | 50 |
| Purified water | | QS | QS | QS |
| Temperature | Time | Percent Enzyme Activity | | |
| 55° C. | 24 hrs. | 92.4 | 89.5 | 10.4 |
| | 1 week | 68.2 | 63.9 | — |
| | 2 weeks | 53.5 | 39.2 | — |
| 45° C. | 1 week | 96.9 | 89.4 | 54.7 |
| | 2 weeks | 94.2 | 84.9 | 45.1 |
| | 4 weeks | 86.4 | 76.4 | — |

The data of Table 2 demonstrates the poor enzyme stability of compositions containing only a polymeric polyol (composition 7) as compared to the efficacious enzyme stability of compositions containing only a monomeric polyol (composition 5). Composition 6, a mixed polyol composition of the present invention, showed similar enzyme stability efficacy as composition 5.

The thermal stability efficacy of a mixed polyol composition of the present invention as compared to a monomeric polyol composition is further illustrated with the following comparative example:

EXAMPLE 4

Enzyme stability efficacy was assessed for a 50% w/v monomeric polyol composition and a 50% w/v mixed polyol composition of the present invention. The experiment was performed as in Example 2 above. The results are presented in Table 3 below:

TABLE 3

Comparison of the Stability of a Monomeric Polyol Composition With a Mixed Polyol Composition of the Present Invention

| Composition | | 8 | 9 |
|---|---|---|---|
| Subtilisin A % w/v | | 0.1 | 0.1 |
| Phenylboronic acid % w/v | | 1.0 | 1.0 |
| Glycerol % w/v | | 50 | 25 |
| PEG 400 w/v | | — | 25 |
| Purified Water | | QS | QS |
| Sodium hydroxide | | pH7.5 | pH7.5 |
| Temperature | Time | Percent Enzyme Activity | |
| 45° C. | 1 week | 98.5 | 97.4 |
| | 2 weeks | 91.9 | 97.0 |
| | 4 weeks | 96.7 | 97.9 |
| | 8 weeks | 94.6 | 95.3 |
| | 12 weeks | 88.7 | 89.3 |
| 55° C. | 1 week | 97.2 | 94.8 |
| | 2 weeks | 91.9 | 92.9 |
| | 4 weeks | 86.3 | 81.5 |
| | 8 weeks | 78.7 | 73.5 |
| | 12 weeks | 66.3 | 47.9 |

The data of Table 3 demonstrate a similar enzyme stability efficacy of a mixed polyol composition (composition 9) of the present invention with that of a monomeric polyol composition (composition 8).

EXAMPLE 5

Preparation of Me-PEG-5000-Subtilisin

A: Carboxymethylation of Me-PEG-5,000

The process of Royer (*Journal of the American Chemical Society,* volume 101, pages 3394–96 (1979)) and Fuke (*Journal of Controlled Release,* volume 30, pages 27–34 (1994)) was generally followed. In brief, 50.0 grams (g) (0.010 moles (mol)) of poly(ethylene glycol) methyl ether (Me-PEG-5000) and about 100 milliliters (mL) of toluene were added to a 1,000 mL round-bottom flask. The contents were concentrated by rotary evaporation to remove residual moisture (two times), and the residue stirred under high vacuum at 80° C. for several hours. 400 mL of t-butanol, which had been distilled over calcium hydride, was added to the dried Me-PEG-5000, and the mixture was redissolved at 60° C. until all material was dissolved. The solution was allowed to cool to about 45° C. and 46.00 g (0.41 mol) of potassium t-butoxide, which had been dried overnight under high vacuum in the presence of $P_2O_5$, was added. After all of the t-butoxide was dissolved in solution, 60.24 g (0.36 mol) of ethyl bromoacetate was added dropwise through an addition funnel to the stirred solution, at 40° C., then stirred at this temperature for 12 hours. Most of the solvent was removed by rotary evaporation and the residue was redissolved in water. An aqueous solution of 28.25 g (0.71 mol) of sodium hydroxide was added and the solution was stirred at room temperature for two hours. This solution was cooled in an ice bath and acidified to about pH 0–1, by the addition of concentrated HCI (70 mL). The acidic solution was extracted with chloroform (6 times with 100 mL each) and the combined extracts dried over $MgSO_4$. The filtrate was concentrated and precipitated with ether, and then filtered. The precipitate was redissolved in a small amount of chloroform and reprecipitated with ether and filtered. The precipitate was dried to afford 47.0 g (94%) of a white powder, corresponding to the Me-PEG-5000 carboxymethylated acid. NMR was used to monitor the reaction progress and to characterize the final product by comparing the integration of the peaks at 3.35 ppm and 4.12 ppm.

B: Preparation of the activated ester of Me-PEG-5,000 carboxymethylated acid:

20.0 grams of dried (over toluene) Me-PEG-5000 carboxymethylated acid was reacted with 1.61 g of N-hydroxysuccinimide and 2.9 g of dicyclohexylcarbodimide (DCC) at 25–30° C. in dimethylformamide (100 ml), for 4 hours. The reaction mixture was then filtered directly into ethyl ether to precipitate the product. The precipitate was dissolved in chloroform (50 ml) and precipitated again with ethyl ether to afford 19.5 g (97.5%) of a crystalline product, the activated ester of Me-PEG-5000. NMR spectra confirmed the structure of the final product by comparison of the integration of the end group methyl protons (3.35 ppm) to the methylene protons alpha to the carbonyl group (4.53 ppm), and the four protons in N-hydroxysuccinimide of the product, as well as the disappearance of the resonance at 4.12 ppm in the starting material.

C: Preparation of Me-PEG-5,000-Subtilisin:

20 In a 3-neck 250 ml flask, 1.35 g (0.05 milimoles (mmol) of Subtilisin A (NovoNordsk, Bagsvaerd, Denmark) in 150 ml borate buffer at 3–5° C., was reacted with 10 g of polyethylene glycol-5000 monomethylether N-hydroxysuccinimide ester (activated Me-PEG-5000). The pH of the reaction mixture was maintained at pH 8.5 with 1 molar (M) sodium hydroxide. An additional 5 g of the activated Me-PEG-5000 was added every hour until a total of 25 g (5 mmol) had been added. The reaction mixture was then stirred for four more hours. The reaction mixture was then dialyzed in a 12,000–14,000 dalton molecular weight cutoff dialysis tubing for two days. This dialyzed material was then lyophilized to yield 23.94 g (90.9%) of Me-PEG-5000-Subtilisin. Gel electrophoresis and ultraviolet spectroscopy were used to characterize and confirm the biochemical and physicochemical properties of the modified product.

The invention in its broader aspects is not limited to the specific details shown and described above. Departures may be made from such details within the scope of the accompanying claims without departing from the principles of the invention and without sacrificing its advantages.

What is claimed is:

1. A liquid enzyme composition for cleaning contact lenses comprising an enzyme in an amount effective to clean the lens; 30–70% w/v of a mixed polyol mixture; and water.

2. The composition according to claim 1, wherein the enzyme is selected from the group consisting of pancreatin, subtilisin, trypsin and Me-PEG-5000-subtilisin.

3. The composition according to claim 1, wherein the mixed polyol mixture is in a ratio of from 1:5 to 5:1, weight:weight, of monomeric polyols:polymeric polyols.

4. The composition according to claim 3, wherein the ratio is from 1:2 to 2:1, weight:weight.

5. The composition according to claim 1, wherein the mixed polyol mixture is comprised of a monomeric polyol and a polymeric polyol, the monomeric polyol is selected from the group consisting of: glycerol, propylene glycol, ethylene glycol, sorbitol and mannitol; and the polymeric polyol is selected from the group consisting of: PEG 200 and PEG 400.

6. The composition according to claim 1, further comprising an enzyme inhibitor selected from the group consisting of a borate compound; a lower carboxylic acid; and an aromatic acid derivative.

7. The composition according to claim 1, wherein the enzyme is selected from the group consisting of: pancreatin, subtilisin, trypsin and Me-PEG 5000-subtilisin; the mixed polyol mixture is comprised of a monomeric polyol and a polymeric polyol, the monomeric polyol is selected from the group consisting of: glycerol, propylene glycol, ethylene glycol, sorbitol and mannitol; the polymeric polyol is selected from the group consisting of: PEG 200 and PEG 400; and further comprising an enzyme inhibitor selected from the group consisting of: a borate compound; a lower carboxylic acid; and an aromatic acid derivative.

8. The composition according to claim 7, wherein the composition has a pH of 7.5, the mixed polyol mixture is comprised of glycerol in the amount of 25% w/v and PEG 400 in the amount of 25% w/v; and the enzyme inhibitor is benzoic acid in the amount of 1.0% w/v.

9. The composition according to claim 8, wherein the enzyme is selected from the group consisting of: pancreatin, subtilisin, trypsin and Me-PEG-5000-subtilisin.

10. The composition according to claim 8, wherein the enzyme is subtilisin in the amount 0.1% w/v.

* * * * *